US008870458B2

(12) United States Patent
La Fuente et al.

(10) Patent No.: US 8,870,458 B2
(45) Date of Patent: Oct. 28, 2014

(54) MULTIPLE POCKET RECLOSABLE DISPOSABLE PLASTIC BAGS AND METHODS FOR MAKING THEM

(76) Inventors: Brian H. La Fuente, Fullerton, CA (US); Maria G. La Fuente, Fullerton, CA (US)

( * ) Notice: Subject to any disclaimer, the term of this patent is extended or adjusted under 35 U.S.C. 154(b) by 428 days.

(21) Appl. No.: 12/436,746

(22) Filed: May 6, 2009

(65) Prior Publication Data

US 2010/0284630 A1 Nov. 11, 2010

(51) Int. Cl.

| | |
|---|---|
| ***B65D 33/10*** | (2006.01) |
| ***B65D 30/22*** | (2006.01) |
| ***B65D 33/16*** | (2006.01) |
| ***B65D 33/04*** | (2006.01) |
| ***B65D 23/12*** | (2006.01) |
| ***B65D 85/00*** | (2006.01) |
| ***B31B 41/00*** | (2006.01) |
| ***B31B 19/86*** | (2006.01) |
| ***B31B 19/90*** | (2006.01) |
| ***B65D 33/08*** | (2006.01) |
| ***B65D 33/25*** | (2006.01) |

(52) U.S. Cl.

CPC ..... *B31B 41/00* (2013.01); *B31B 19/86* (2013.01); *B31B 19/90* (2013.01); *B65D 31/12* (2013.01); *B65D 33/08* (2013.01); *B65D 33/2508* (2013.01); *B31B 2219/9009* (2013.01); *B31B 2219/909* (2013.01); *B31B 2221/05* (2013.01); *B31B 2221/10* (2013.01)

USPC ..... 383/10; 383/38; 383/63; 383/106; 206/459.5; 206/730

(58) Field of Classification Search

CPC ..... B65D 31/12; B65D 33/2508; B65D 33/2566; B65D 81/3261

USPC ..... 383/38–40, 63, 64, 106, 120, 104, 10; 229/72; 150/117; 206/256, 730, 459.5

See application file for complete search history.

(56) References Cited

U.S. PATENT DOCUMENTS 2,508,825 A * 5/1950 Lewis ..... 150/110
3,181,751 A * 5/1965 Wilson ..... 383/39

(Continued)

FOREIGN PATENT DOCUMENTS

FR 2 406 969 A * 6/1979
JP 11009412 A * 1/1999 ..... A47G 9/02

(Continued)

OTHER PUBLICATIONS

Machine translation of FR 2 406 969 A description. Translated on Aug. 13, 2013.*

(Continued)

*Primary Examiner* — Jes F Pascua

(74) *Attorney, Agent, or Firm* — William A. English; Vista IP Law Group LLP

(57) ABSTRACT

Disposable plastic bags are provided that include multiple internal compartments and methods for making such bags. In one embodiment, a disposable plastic bag includes substantially transparent outer panels attached together to define a main compartment, an opening for accessing the main compartment, a main closure for selectively opening and closing the opening into the main compartment; and a plurality of internal panels attached to one of the outer panels to define a plurality of internal compartments separate from and accessible through the main compartment, the internal panels comprising closures for selectively opening and closing the respective internal compartments.

22 Claims, 5 Drawing Sheets

(56) References Cited

U.S. PATENT DOCUMENTS

| | | | | | |
|---|---|---|---|---|---|
| 3,443,671 | A * | 5/1969 | Dyke | 190/103 |
| 3,870,132 | A * | 3/1975 | Hanley | 190/109 |
| 4,022,261 | A * | 5/1977 | Russell | 150/129 |
| 4,685,570 | A * | 8/1987 | Medow | 206/579 |
| 4,993,844 | A | 2/1991 | Robinson et al. | |
| 5,024,536 | A | 6/1991 | Hill | |
| 5,102,234 | A * | 4/1992 | Levy | 383/38 |
| 5,791,485 | A * | 8/1998 | Carbonneau | 206/720 |
| 5,804,265 | A | 9/1998 | Saad et al. | |
| 5,851,069 | A | 12/1998 | Davoren | |
| 6,231,233 | B1 * | 5/2001 | Orce | 383/38 |
| 6,328,158 | B1 * | 12/2001 | Bisbal et al. | 206/223 |
| 6,409,385 | B1 | 6/2002 | Gee | |
| 6,422,032 | B1 * | 7/2002 | Greene | 62/457.2 |
| 6,929,401 | B2 * | 8/2005 | Matusewicz | 383/113 |
| 7,011,615 | B2 | 3/2006 | Price et al. | |
| 7,140,491 | B2 | 11/2006 | Wang et al. | |
| 7,147,374 | B2 * | 12/2006 | Ajootian | 383/13 |
| 2002/0067865 | A1 | 6/2002 | Stutzman | |
| 2003/0236159 | A1 * | 12/2003 | Worthy, Jr. | 493/394 |
| 2004/0042688 | A1 | 3/2004 | Lee | |
| 2005/0232517 | A1 * | 10/2005 | Reid | 383/2 |
| 2007/0189639 | A1 * | 8/2007 | Revness | 383/37 |
| 2008/0240628 | A1 | 10/2008 | VanLoocke et al. | |
| 2009/0238499 | A1 * | 9/2009 | Steele | 383/200 |
| 2010/0012543 | A1 * | 1/2010 | Heidrich | 206/459.5 |
| 2011/0110611 | A1 * | 5/2011 | Apple | 383/40 |
| 2014/0219585 | A1 * | 8/2014 | Oberlin et al. | 383/40 |

FOREIGN PATENT DOCUMENTS

| | | | | |
|---|---|---|---|---|
| JP | 2005263256 | A * | 9/2005 | B65D 30/22 |
| WO | 9833717 | A1 | 8/1998 | |
| WO | 2004002725 | A1 | 1/2004 | |
| WO | WO 2004002852 | A1 * | 1/2004 | B65D 81/32 |
| WO | WO 2008020098 | A1 * | 2/2008 | A45C 13/30 |

OTHER PUBLICATIONS

Machine translation FR 2 406 969 A claims. Translated on Aug. 13, 2013.*

* cited by examiner

MULTIPLE POCKET RECLOSABLE DISPOSABLE PLASTIC BAGS AND METHODS FOR MAKING THEM

FIELD OF THE INVENTION

The present invention relates generally to reclosable plastic bags, and, more particularly, to disposable plastic bags including multiple internal pockets, which may be reclosable, and to methods for making and using them.

BACKGROUND

Reclosable plastic bags are disclosed in U.S. Pat. Nos. 4,993,844, 5,024,536, 7,011,615, 7,140,491, and in U.S. Publication No. 2008/0240628. The entire disclosures of these references are expressly incorporated by reference herein.

SUMMARY

The present invention is generally directed to reclosable plastic bags, and, more particularly, to disposable plastic bags including multiple internal pockets, which may be recloseable, and to methods for making and using them.

In accordance with one embodiment, a disposable plastic bag is provided that includes first and second outer panels attached together to define closed side and bottom edges defining a main compartment, the outer panels including top edges defining an opening for accessing the main compartment; a main closure extending along the top edges of the first and second outer panels for selectively opening and closing the opening into the main compartment; and a first internal panel including one or more edges attached to the first outer panel to define a first internal compartment separate from and accessible through the main compartment. A first closure may be attached along at least one edge thereof for selectively opening and closing the first internal compartment.

Optionally, the plastic bag may include a second internal panel including one or more edges attached to one of the first and second outer panels to define a second internal compartment separate from and accessible through the main compartment, and a second closure along at least one edge of the second internal panel for selectively opening and closing the second internal compartment.

In accordance with another embodiment, a disposable plastic bag is provided that includes substantially transparent outer panels attached together to define a main compartment, an opening for accessing the main compartment, a main closure for selectively opening and closing the opening into the main compartment; and a plurality of internal panels attached to one of the outer panels to define a plurality of internal compartments separate from and accessible through the main compartment, the internal panels comprising closures for selectively opening and closing the respective internal compartments.

In accordance with still another embodiment, a method is provided for making a disposable plastic bag that includes forming first and second outer panels from one or more plastic sheets; attaching a first internal panel to a first surface of the first outer panel to define a first internal compartment, attaching a first closure along an open edge of the first internal panel for selectively opening and closing the first internal compartment, and attaching edges of the outer panels together such that the outer panels define a main compartment, the outer panels defining an opening for accessing the main compartment, the first internal compartment being accessible through the main compartment.

For example, a first closure strip may be attached to the first internal panel along the at least one edge, and a second mating closure strip may be attached to the first outer panel opposite the first closure strip, the second closure strip engaging with the first closure strip when the first and second closure strips are directed together to close the first internal compartment.

Optionally, a second internal panel may be attached to the first surface of the first outer panel adjacent the first internal panel to define a second internal compartment, and a second closure may be attached along an open edge of the second internal panel for selectively opening and closing the second internal compartment.

In addition or alternatively, a main closure may be attached to the outer panels along the opening for selectively opening and closing the opening.

The above summary is not intended to describe each embodiment or every implementation of the present invention. Rather, a more complete understanding of the invention will become apparent and appreciated by reference to the following detailed description and claims in view of the accompanying drawings.

DETAILED DESCRIPTION OF THE EXEMPLARY EMBODIMENTS

Figure 1:
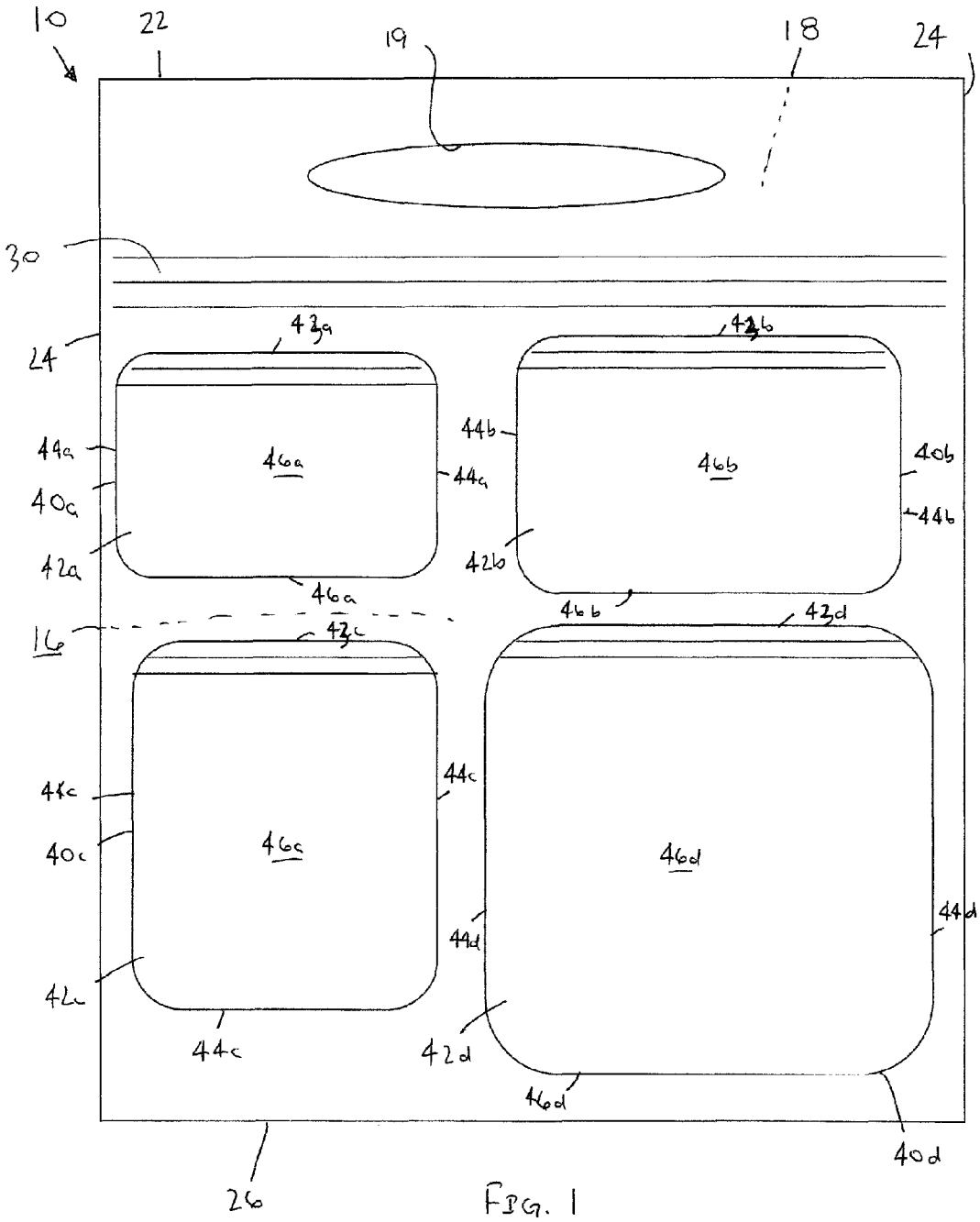
FIG. 1 is a side view of an exemplary embodiment of a plastic bag that includes multiple reclosable internal pockets.
Figure 2:
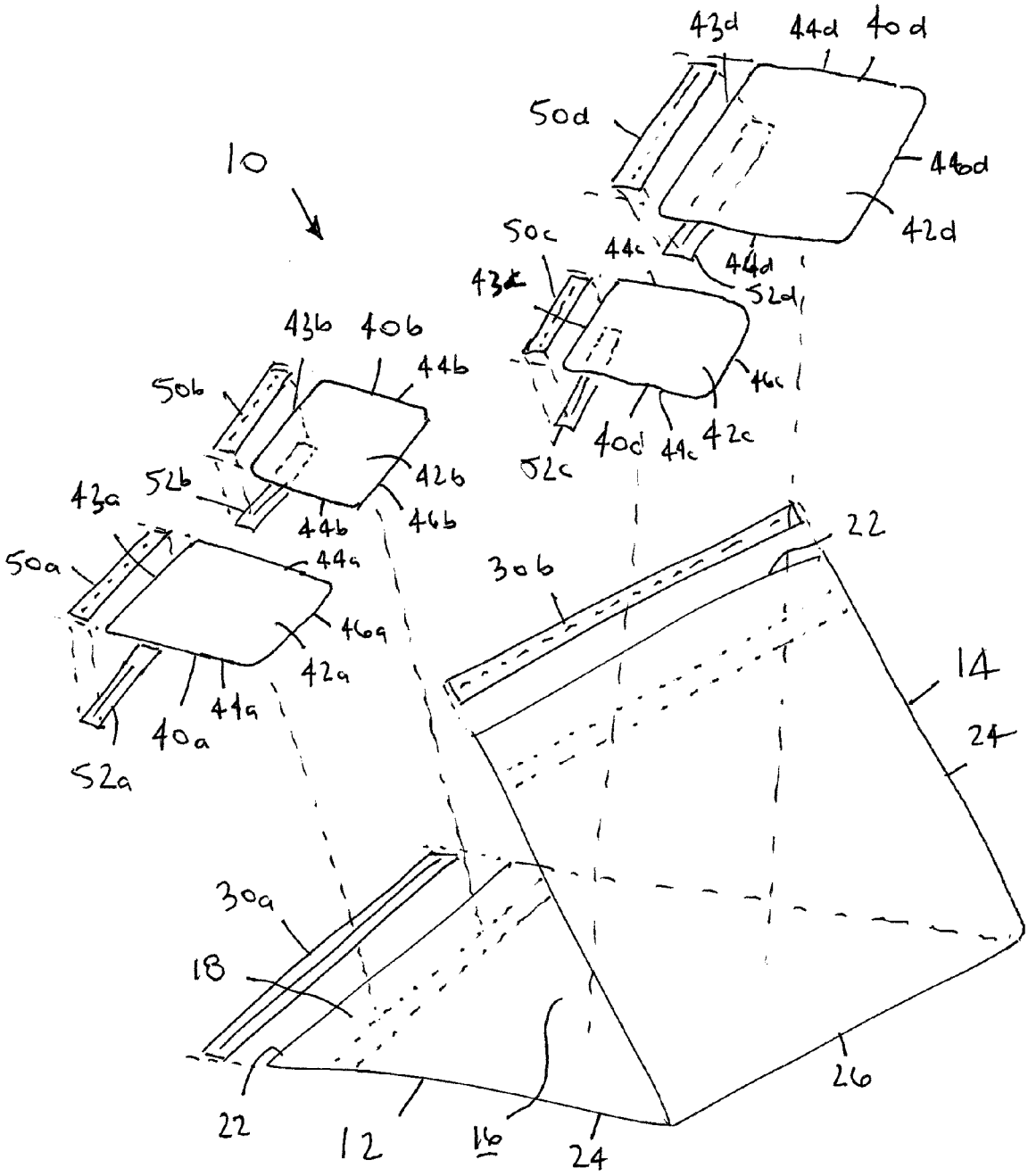
FIG. 2 is an exploded view of the components for making the plastic bag of FIG. 1.

Turning to the drawings, FIGS. 1 and 2 show an exemplary embodiment of a disposable plastic bag 10 that includes a plurality of internal recloseable or resealable pockets 40. Generally, the bag 10 includes a first outer panel 12 and a second outer panel 14, each including a top edge 22, side edges 24, and a bottom edge 26. The outer panels 12, 14 may be attached together along the side and bottom edges 24, 26 to define a main compartment 16 between the outer panels 12, 14 that is accessible through an opening 18 between the top edges 22.

In the embodiment shown in FIG. 2, the first and second outer panels 12, 14 are formed from a single sheet of material, which may be folded in half to define the first and second outer panels 12, 14, e.g., with the folded edge defining the bottom edges 26 (or alternatively, the folded edge may define one of the side edges 24, not shown). In an alternative embodiment, the first and second outer panels 12, 14 may be formed as separate sheets (not shown), which may be attached together along the side and bottom edges 24 26 to define the main compartment 16.

Figure 3:
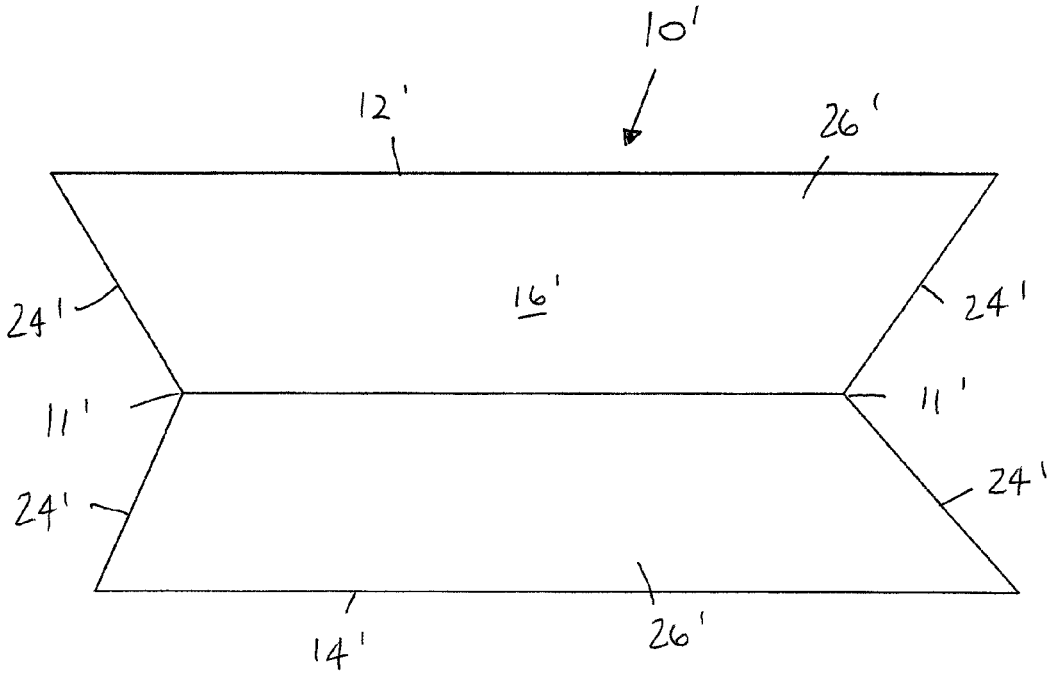
FIG. 3 is a bottom view of an alternative embodiment of the plastic bag of FIGS. 1 and 2.

Optionally, as shown in FIG. 3, the bag 10' may include one or more pleats 11', e.g., along at least one of the sides and bottom of the bag 10', e.g., which may allow the bag 10' to create a substantially flat bottom surface opposite the opening (not shown) and/or increase the volume of the main compartment 16'. For example, the bag 10' may include first and second outer panels 12', 14' that include additional portions 24', 26' extending from the outer panels 12', 14'. The additional portions 24', 26' may be folded or otherwise attached to one another to substantially close the bottom of the bag 10' and/or otherwise provide a desired shape and/or size for the finished bag 10'.

Returning to FIG. 1, optionally, if desired, at least one of the outer panels 12, 14 may include a handle 19 adjacent the opening 18. For example, the handle 19 may simply be an opening formed through one or both of the outer panels 12, 14 adjacent the top edges 22 as shown in FIG. 1. Alternatively, the handle may extend above the top edges 22, e.g., by attaching a separate component to one or both of the outer panels 12, 14, such as a rope, separate plastic handle, and the like (not shown).

The top edges 22 of the outer panels 12, 14 may be substantially free between the side edges 24, e.g., such that the opening 18 for accessing the main compartment 16 extends substantially entire across the top edges 22. Alternatively, the top edges 22 may be attached together partially along their lengths, e.g., for a relatively short distance from each of the side edges 24. In a further alternative, one or both side edges may also be at least partially free such that the opening may extend from the top edges 22 at least partially along one or more both side edges 24 (not shown).

A main reclosable closure 30 may extend along the top edges 22 of the outer panels 12, 14 for selectively opening and closing the opening 18 into the main compartment 16. For example, mating closure strips 30*a*, 30*b* may be attached adjacent the top edges 22, e.g., along interior surfaces of the first and second outer panels 12, 14 opposite one another. The closure strips 30*a*, 30*b* may extend substantially the entire distance between the side edges 24 or may only extend partially along the length of the opening 18. In an exemplary embodiment, a first main closure strip 30*a* may include a channel (not shown) extending along the length of the closure strip 30*a*, and a second main closure strip 30*b* may include a hook, bead, or other protrusion (also not shown) extending along the length of the other closure strip 30*b*. The protrusion is generally shaped or otherwise configured to be securely yet removably received in the channel, e.g., to providing a reclosable zip-lock connector, as described further below.

With particular reference to FIG. 2, the internal pockets 40 are formed from respective internal panels 42 defining one or more edges, e.g., top edges 43, side edges 44, and bottom edges 46. The side and bottom edges 44, 46 of the internal panels 42 may be attached to one of the outer panels 12, 14 to provide a plurality of internal compartments 46 separate from and accessible through the main compartment 16. In the exemplary embodiment shown, the bag 10 includes four internal pockets 40*a*-40*d* defined by respective internal panels 42*a*-42*d* attached to the first outer panel 12. In alternative embodiments, one or more additional internal panels may also be attached to the second outer panel 14, and/or fewer or more internal panels may be attached to the first outer panel 12, as desired.

The internal panels (and consequently the internal pockets) may all be the same size and shape or one or more of the panels may be larger, smaller, or have different shapes than others. For example, as shown, pocket 46*d* is substantially square and larger than pocket 46*a*, which is rectangular. In addition, as shown the internal panels 40 have rounded corners between the top, side, and bottom edges, 43, 44, 46, although alternatively, one or more of the corners may be abrupt or have other shapes, as desired (not shown).

As shown in FIGS. 1 and 2, each of the internal panels 42*a*-42*d* includes side and bottom edges 44*a*-44*d*, 46*a*-46*d* attached to the first outer panel 12 and an open top edge 43*a*-43*d* allowing access into the respective internal compartments 46*a*-46*d*. Thus, the open top edges 43 may be oriented towards the opening 18 to facilitate accessing the internal compartments 46. Alternatively, one or more of the pockets 40 may include open side edges 44 (not shown), either instead of or in addition to the open top edges 43, if desired.

Each top edge 43*a*-43*d* includes a first reclosable closure strip 50*a*-50*d* attached along the top edge 48*a*-488*d* thereof, e.g., along an inner surface of the respective internal panel 42*a*-42*d*. In addition, a second mating closure strip 52*a*-52*d* may be attached to the first panel 12 opposite the first closure strip 50*a*-50*d* such that the closure strips 50*a*-50*d*, 52*a*-52*d* may selectively engage one another for opening and closing the respective internal compartment 46*a*-46*d*.

Figure 4A:
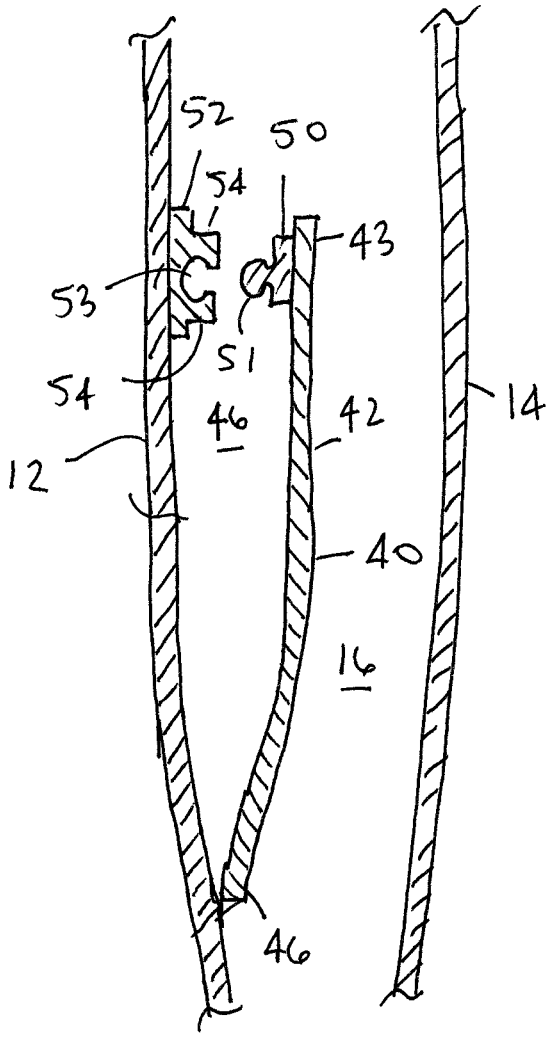
FIG. 4A is a cross-sectional detail showing a reclosable closure for selectively opening and closing an internal pocket of the plastic bag of FIG. 1.

FIG. 4A is a cross-sectional view showing an exemplary embodiment of an internal pocket 40 defined by an internal panel 42 including a bottom edge 46 attached to an inner surface of a first outer panel 12. The side edges of the internal panel 42 (not shown) may also be attached to the first outer panel 12, or one or both of the side edges may include a reclosable closure, e.g., the same closure 50 that extends along the top edge 43. As shown, the internal panel 42 includes a first closure strip 50 attached along the top edge 43 of the internal panel 42, and the first outer panel 12 includes a second mating closure strip 52 attached opposite the first closure strip 50. In the embodiment shown, the first closure strip 50 includes a bead 51 extending along a length of the strip 50, and the second closure strip 52 includes a similarly shaped channel 53 defined by ridges 54 extending along a length of the strip 52, although it will be appreciated that the configuration of the closure strips 50, 52 may be reversed, if desired.

The material of the closure strips 50, 52 may be sufficiently flexible to allow the ridges 54 to at least partially separate when pressure is applied to push the bead 51 into the channel 53. For example, the rounded shape of the bead 51 may cause the ridges 54 to separate sufficiently to allow the bead 51 to enter the channel 53, whereupon the ridges 54 may resiliently return inwardly to capture the bead 51. Thus, the ridges 54 may engage the bead 51, thereby closing the internal compartment 46 and preventing the bead 51 from accidentally being removed from the channel 53. If sufficient force is applied to pull the top edge 43 of the internal panel 42 away from the first outer panel 12, the ridges 54 may again separate to allow the bead 51 to be pulled out of the channel 53, e.g., to open the internal pocket 40 and allow access into the compartment 46.

Figure 4B:
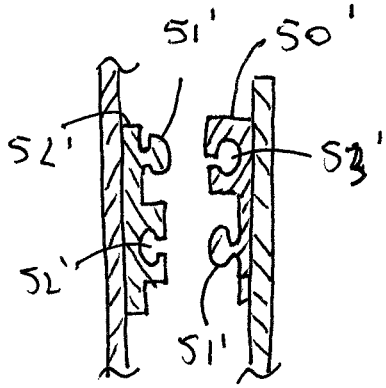
FIGS. 4B and 4C are cross-sectional details of alternative embodiments of reclosable closures that may be provided for selectively opening and closing an internal pocket of the plastic bag of FIG. 1.

In alternative embodiments, the protrusion, channel, and/or ridges may have other complementary shapes or configurations. For example, as shown in FIG. 4B, multiple sets of channels 53' and protrusions 51' may be provided for the closure strips 50', 52'. As shown, each strip 50', 52' includes a bead 51' and a channel 53' adjacent one another that are oriented opposite one another such that the beads 51' are received in the respective channels 53' when the strips 50', 52' are pressed together. Alternatively, if desired, a pair of channels (not shown) may be provided in one strip, and a pair of complementary protrusions (also not shown) may be provided in the other strip.

Figure 4C:
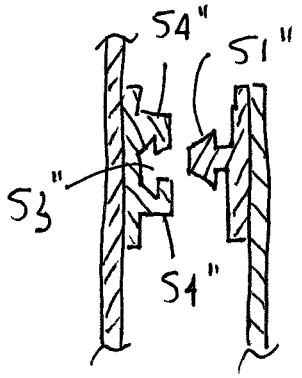

In a further alternative, as shown in FIG. 4C, the protrusion 51" may have a hook or arrowhead shape, e.g., including a tapered tip and blunt edges. The channel 52" may be defined by ridges 54" that include blunt upper lips. The tapered tip may facilitate inserting the protrusion 51" into the channel 52", e.g., applying force to separate or open the ridges 54". Once the protrusion 51" is received in the channel 52", the blunt edges may prevent the protrusion 51" from being subsequently removed from the channel 52". Additional exemplary configurations of zip-lock connectors that may be used for the main or internal closures, as well as methods for making and using them are disclosed in U.S. Pat. Nos. 4,212,337, 5,403,094, 5,947,603, and 6,305,844, and U.S. Publication No. 2006/0165316, the entire disclosures of which are expressly incorporated by reference.

Returning to FIG. 1, the components of the bag 10 may be formed from a variety of materials, such as relatively inexpensive, flexible, and/or disposable plastics, e.g., polyvinylchloride, polyethylene, polypropylene, and the like. If desired, the plastic material may be substantially transparent, translucent, opaque, and/or colored, as desired. For example, substantially transparent materials may facilitate identifying objects within the main compartment 16 and/or the internal compartments 46 through the outer panels 12, 14 and/or through the internal panels 42.

During manufacturing, the components of the bag 10 (or multiple bags) may be cut, separated, or otherwise formed and assembled in a variety of orders or sequences, and the exemplary process described herein may be modified, e.g., to change the sequence of steps, individual process steps, and the like. In an exemplary process, the outer panels 12, 14 and internal panels 42 may be formed from one or more relatively thin sheets of substantially transparent plastic, e.g., having a thickness between about one and five mils (0.025-0.127 mm). Generally, the first and second outer panels 12, 14 may be formed from a plastic sheet, for example, by cutting the outer panels 12, 14 (individually or together sharing a common edge as shown in FIG. 2) from a larger sheet or roll, e.g., by slitting or other mechanically cutting, stamping, laser cutting, and the like.

The internal panels 42 may be attached to a first or exposed surface (ultimately interior surface) of the first outer panel 12 (see FIG. 2), for example, by attaching the side and bottom edges 44, 46 of the individual panels 42 to the surface, e.g., by bonding with adhesive, heat sealing, sonic welding, or other fusing. If the second outer panel 14 includes pockets, the panels for these pockets may be attached to a first or exposed surface (ultimately the interior surface) of the second outer panel 14 at the same time as those attached to the first outer panel 12 (or in immediate succession). Any excess material along the attached edges may be removed, as desired, to provide a desired finish around the attached panels 42. However, if the panels 42 are attached at the very edges themselves, there may be little or no excess material to remove.

The internal panels 42 (and/or other components) may be attached to the first and/or second panels 12, 14 before or after separating the first and second panels 12, 14 from a larger sheet or roll. For example, in one embodiment, a larger sheet including sufficient outer panels for multiple bags (not shown) may have a plurality of panels attached to the appropriate surfaces and locations on the larger sheet, whereupon the larger sheet may be separated into sets of outer panels for individual bags.

Closures 50, 52 may be attached along one or more edges, e.g., the top edges 43, of the internal panels 42 for selectively opening and closing the respective internal compartments 46. For example, each closure 50, 52 may include a first closure strip 50 attached to each of the internal panels 42 along at least one edge, e.g., the top edge 43, and a second mating closure strip 52 attached to the first outer panel 12 (or second outer panel 12 if the panels are attached thereto) opposite the first closure strip 50. As described above, the second closure strips 52 may engage the first closure strips 50 when the first and second closure strips 50, 52 are directed together to close the respective internal compartments 46. The closure strips 50, 52 may be attached to the panels 12, 14, 42 using a variety of processes, such as bonding with adhesive, sonic welding, heat sealing, other fusing, and the like.

The closure strips 50, 52 may be formed as individual pieces, e.g., by injection molding, and the like, or may be formed using a substantially continuous process. In an exemplary embodiment, plastic material for the closure strips 50, 52 may extruded through one or more sets of dies (not shown) corresponding to the desired cross-sections of the closure strips 50, 52, e.g., substantially continuously, and then the resulting extrusion may be cut to desired length, e.g., by shearing with a blade, wire, or other cutting tool, laser cutting, and the like. The individual lengths may then be attached to the appropriate panels 12, 14, 42 as described elsewhere herein.

Optionally, during an automated assembly process, the second closure strips 52 may be attached to the outer panel(s) 12, 14 before the internal panels 42 are attached to the outer panel(s) 12, 14. For example, the second closure strips 52 may be attached to the larger sheet at predetermined locations corresponding to the intended locations for the internal panels 42 on the outer panel(s) 12, 14. The internal panels 42, e.g., with the first closure strips 50 already attached thereto, may then be attached to the outer panel(s) 12, 14 such that the top edges 43 of the internal panels 42 overly the second closure strips 52 and the first closure strips 50 are properly aligned with the second closure strips 52.

If the outer panels 12, 14 include a main closure 30 for closing the main compartment 16 of the bag 10, the closure strips 30*a*, 30*b* (see FIG. 2) of the main closure 30 may be attached to the outer panels 12, 14, e.g., before or after separating the outer panels 12, 14 from a larger sheet or roll. For example, the closure strips 30*a*, 30*b* may be attached at predetermined locations on the larger sheet when the second closure strips 52 for the internal pockets 40 are attached. Once the necessary closure strips 50, 52 and internal panels 42 are attached to the larger sheet, the sheet may be cut or otherwise separated into individual sets of outer panels 12, 14 intended for individual bags. Alternatively, the closure strips 30*a*, 30*b* may be attached along the top edges 22 of the outer panels 12, 14 after separating the outer panels 12, 14.

The first and second outer panels 12, 14 may then be attached together with the internal panels 42 oriented inwardly such that the outer panels 12, 14 define the main compartment 16. For example, as shown in FIG. 2, if the outer panels 12, 14 are formed as a single sheet, the outer panels 12, 14 may be folded along the common edge, e.g., the bottom edge 26. The side edges 24 may then be attached together, e.g., by bonding with adhesive, sonic welding, heat sealing, and the like, leaving the top edges 22 substantially free and defining the opening 18 for accessing the main compartment 16. Alternatively, if the first and second panels 12, 14 are separate, the bottom edges 24 may also be attached together, e.g., by bonding with adhesive, sonic welding, heat sealing, and the like. If the main closure 30 has not been attached to the outer panels 12, 14, the main closure strips 30*a*, 30*b* may be attached, thereby providing a fully assembled disposable bag 10.

If the bag 10 includes a handle 19, any necessary components for the handle may be attached to the bag 10 before or after the outer panels 12, 14 are attached together. For example, if the handle 19 is merely openings in the outer panels 12, 14, the openings may be cut or otherwise formed in the outer panels 12, 14 at any time, e.g., when the outer panels 12, 14 are separated from a larger sheet or roll.

Figure 5:
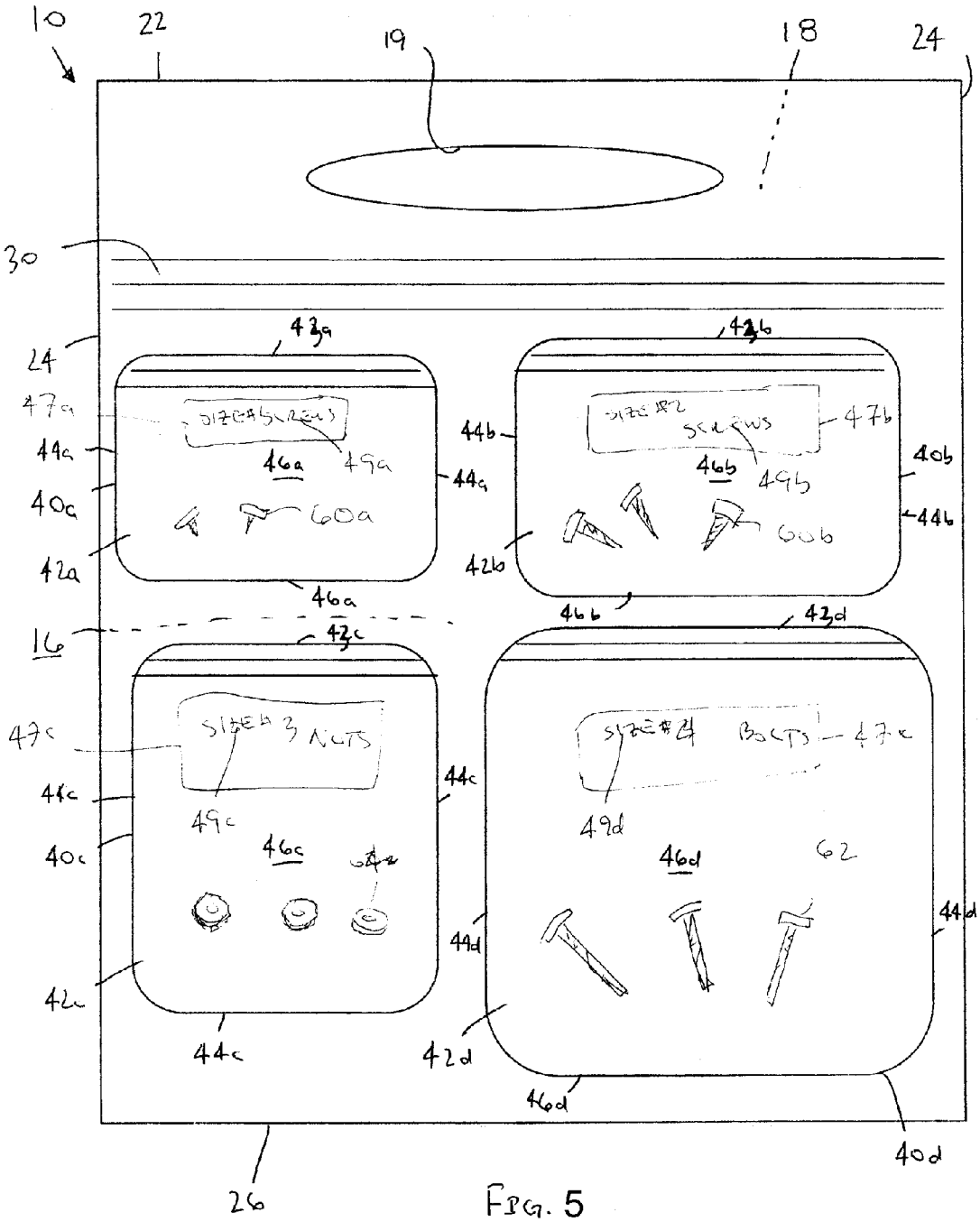
FIG. 5 is a side view of another exemplary embodiment of a plastic bag that includes multiple reclosable internal pockets labeled to identify different items placed in the pockets.

Any other features may also be provided on the bag 10 at any appropriate time during assembly. For example, as shown in FIG. 5, the bag 10 may include one or more labels 47. If the bag 10 includes one or more labels 47, printed text, and the like, they may be applied to the outer panels 12, 14, e.g., before or after separating the outer panels 12, 14 from a larger sheet or roll. For example, printing may be applied to outer surfaces of the outer panels 12, 14 before the internal panels 42 and/or closures 30, 52 are attached, which may facilitate printing since the outer panels 12, 14 may remain substantially planar.

The resulting bags may be used for a variety of applications. For example, the bags may be used to store and/or organize goods in a convenient, portable, disposable manner. As an example, the bag 10 may be used as a disposable lunch container with different portions of a meal (or meals or snacks) located in separate pockets 40 in the bag 10. Similarly, the bag 10 may be used to separate hardware, e.g., fasteners, tool components, and the like into like items. For example, as shown in FIG. 5, similar size and/or configuration screws 60, nails, bolts 62, washers 64, and the like may be placed in separate internal compartments 46, which may be labeled, e.g., on the outer surface of the outer panels 12, 14 over the respective internal compartments, to identify which items are in which internal compartments. As shown in FIG. 5, labels 47 for each of the internal compartments 46 have been labeled with descriptors 49 identifying the items 60-64 placed therein.

If provided in a sufficiently large size, e.g., having a volume of multiple gallons, the bag may be used as a disposable travel bag, a clothing and/or make-up organizer, and the like. Once the contents of the bag are depleted or the bag is otherwise no longer needed, the bag may simply be discarded or recycled since the costs of making such bags should be relatively inexpensive compared to luggage or make-up kits.

Exemplary embodiments of the present invention are described above. Those skilled in the art will recognize that many embodiments are possible within the scope of the invention. Other variations, modifications, and combinations of the various components and methods described herein can certainly be made and still fall within the scope of the invention. Thus, the invention is limited only by the following claims, and equivalents thereto.

We claim:

1. A disposable plastic bag, comprising:

first and second outer panels, each formed from a single sheet of substantially transparent material attached together along respective side and bottom edges to define permanently closed side and bottom edges defining a main compartment between the first and second outer panels, the outer panels including top edges defining an opening for accessing the main compartment;

a reclosable main closure comprising male and female closure strips fused along the top edges opposite one another for selectively opening and closing the opening into the main compartment;

a first internal panel formed from substantially transparent material and including one or more edges fused along side edges thereof to the first outer panel to define a first internal compartment separate from and accessible through the main compartment, the first internal panel comprising one of a male and female closure strip fused along at least one edge thereof and a mating closure strip fused to the first outer panel such that the closure strips slidably engage one another for selectively opening and closing the first internal compartment independent of the main closure selectively opening and closing the opening into the main compartment; and a blank label on an outer surface of the first outer panel over the first internal compartment to allow printed text to be applied to the label to identify items therein.

2. The plastic bag of claim 1, further comprising a second internal panel including one or more edges fused along side edges thereof to one of the first and second outer panels to define a second internal compartment separate from and accessible through the main compartment, the second internal panel comprising one of a male and female closure strip fused along at least one edge thereof and a mating closure strip fused to the first outer panel such that the closure strips slidably engage one another for selectively opening and closing the second internal compartment.

3. The plastic bag of claim 2, further comprising:

a label on an outer surface of the one of the first and second outer panels over the second internal compartment; and a plurality of items stored in each of the first and internal compartments, wherein a first set of items having a similar size or configuration are stored in the first internal compartment, and wherein a second set of items having a similar size or configuration different than the first set is stored in the second internal compartment.

4. The plastic bag of claim 1, wherein the closure strips comprise a zip-lock connector including at least one protrusion extending along a length of the male closure strip and at least one complementary shaped channel extending along a length of the female closure strip for capturing the protrusion therein.

5. The plastic bag of claim 1, wherein at least one of the first and second outer panels includes an opening therethrough to define a handle above the top edges of the first and second outer panels.

6. A disposable plastic bag, comprising:

first and second outer panels, each formed from a single sheet of substantially transparent plastic and permanently attached together along closed side and bottom edges defining a main compartment between the outer panels, the outer panels including edges defining an opening for accessing the main compartment;

a main reclosable closure extending adjacent the edges of the outer panels along the opening for selectively opening and closing the opening into the main compartment;

a plurality of internal panels, each internal panel formed from a substantially transparent sheet attached to one of the outer panels to define a plurality of internal compartments separate from and accessible through the main compartment, each internal panel comprising a reclosable closure along at least one edge thereof for selectively opening and closing the respective internal compartment; and a plurality of blank labels on an outer surface of the first outer panel over respective internal compartments to allow printed text to be applied to the label for identifying items therein.

7. The plastic bag of claim 6, wherein the reclosable closure of each internal panel comprises one of a male and female closure strip attached along the at least one edge of the internal panel, the first closure further comprising a mating closure strip attached to the first outer panel such that the closure strips engage one another for closing the first internal compartment.

8. The plastic bag of claim 7, wherein the closure strips comprise a zip-lock connector.

9. The plastic bag of claim 6, wherein at least one of the first and second outer panels includes an opening therethrough to define a handle above the top edges of the first and second outer panels.

10. The plastic bag of claim 6, wherein the plurality of internal panels are smaller than the outer panels, and wherein at least one internal panel is smaller than another internal panel.

11. The plastic bag of claim 6, wherein the main closure comprises one of a male and female closure strip attached along one of the top edges of the first and second outer panels and a mating closure strip attached to the top edge of the other of the first and second outer panels such that the closure strips engage one another for closing the main compartment.

12. The plastic bag of claim 11, wherein the closure strips comprise a zip-lock connector including at least one protrusion extending along a length of the male closure strip and at least one complementary shaped channel extending along a length of the female closure strip for capturing the protrusion therein.

13. The plastic bag of claim 6, wherein a first internal panel is disposed further from the opening into the main compartment than a second internal panel.

14. A disposable plastic bag, comprising:

first and second outer panels formed from a single substantially transparent plastic sheet and permanently attached together along closed side and bottom edges defining a substantially flat bag defining a main compartment between the outer panels, the outer panels including edges defining an opening for accessing the main compartment and a bottom opposite the opening;

a main reclosable closure extending adjacent the edges of the outer panels along the opening for selectively opening and closing the opening into the main compartment, the main closure comprising a first closure strip including a channel extending along the length of the first closure strip, and a second closure strip including a protrusion extending along the length of the second closure strip, the protrusion generally shaped to be securely yet removably received in the channel;

first and second transparent plastic internal panels attached to one of the outer panels to define first and second internal compartments separate from and accessible through the main compartment, each internal panel comprising a reclosable closure along at least one edge thereof for selectively opening and closing the respective internal compartment; and a plurality of items stored in each of the first and internal compartments, wherein a first set of items having a similar size or configuration are stored in the first internal compartment, and wherein a second set of items having a similar size or configuration different than the first set is stored in the second internal compartment.

15. The plastic bag of claim 14, further comprising a label on the first outer panel over each of the first and second internal compartments.

16. The plastic bag of claim 15, wherein the labels are labeled to identify items in the first and second internal compartments.

17. The plastic bag of claim 15, wherein the label is a blank label to allow printed text to be applied to the label to identify items therein.

18. The plastic bag of claim 14, wherein the second internal panel is disposed further from the opening into the main compartment than the first internal panel.

19. The plastic bag of claim 18, wherein the second internal panel is below the first internal panel in the first outer panel.

20. The plastic bag of claim 19, wherein the reclosable closures on the first and second internal panels are closer to the opening into the main compartment than the bottom.

21. The plastic bag of claim 18, wherein the second internal panel is below the first internal panel on the first outer panel.

22. The plastic bag of claim 14, wherein the plurality of items comprise hardware.

* * * * *